US005322489A

United States Patent [19]

Webb et al.

[11] Patent Number: 5,322,489

[45] Date of Patent: Jun. 21, 1994

[54] ASSISTED CHIN AND DIP EXERCISE APPARATUS

[75] Inventors: Gregory M. Webb, Independence; William F. Halsey, Galex, both of Va.

[73] Assignee: Nautilus Acquisition Corporation, Independence, Va.

[21] Appl. No.: 45,355

[22] Filed: Apr. 2, 1993

[51] Int. Cl.[5] ..... A63B 23/12

[52] U.S. Cl. ..... 482/38; 402/41; 402/100; 402/133; 402/137

[58] Field of Search ..... 482/26, 38–42, 482/51, 70, 71, 97–103, 112–113, 133–137, 142, 148

[56] References Cited

U.S. PATENT DOCUMENTS

| | | | |
|---|---|---|---|
| 3,614,097 | 10/1971 | Blickman | 482/38 X |
| 3,701,529 | 10/1972 | Kruthaupt | 482/38 X |
| 3,707,285 | 12/1972 | Martin | 482/38 |
| 3,752,473 | 8/1973 | LaLanne | 482/38 |
| 3,970,302 | 7/1976 | McFee | 482/112 X |
| 4,111,414 | 9/1978 | Roberts . | |
| 4,781,374 | 11/1988 | Lederman . | |
| 4,846,458 | 7/1989 | Potts . | |
| 5,011,139 | 4/1991 | Towley . | |

FOREIGN PATENT DOCUMENTS 9218202 10/1992 PCT Int'l Appl. ..... 482/41

OTHER PUBLICATIONS

Universal 1981–82 catalog, Jun. 1, 1981, p. 12.
Soloflex catalog, 1981, p. 23.

*Primary Examiner*—Robert Bahr
*Attorney, Agent, or Firm*—Bell, Seltzer, Park & Gibson

[57] ABSTRACT

An exercise machine for assisting a user in performing chin-ups and dips includes a pair of handles attached to a frame and a kneeling platform operably connected to the frame by a four-bar linkage. The pair of handles may be a pair of chin-up handles attached to an upper portion of the frame or a pair of dip handles attached to a medial portion of the frame. The four-bar linkage moves the kneeling platform along an arcuate path of travel corresponding to the natural arcuate path of the center of gravity of the user during a chin-up or a dip so that the kneeling platform remains beneath the user's center of gravity during performance of a chin-up or a dip. The four-bar linkage also preferably maintains the kneeling platform in a horizontal orientation. A selectable number of weights urge the kneeling platform upward so that the user may lift his body with his arms while applying a force less than his own body weight.

28 Claims, 6 Drawing Sheets 15
17
14
30
36a
36b
18
38
24
20
21
36c
22
44
32
34
44
26
41
40
16

17
30
36a
15
38
36b
18
32
34
14
28
36c
24
44
20
22
44
41
40
26
16

Fig. 11.
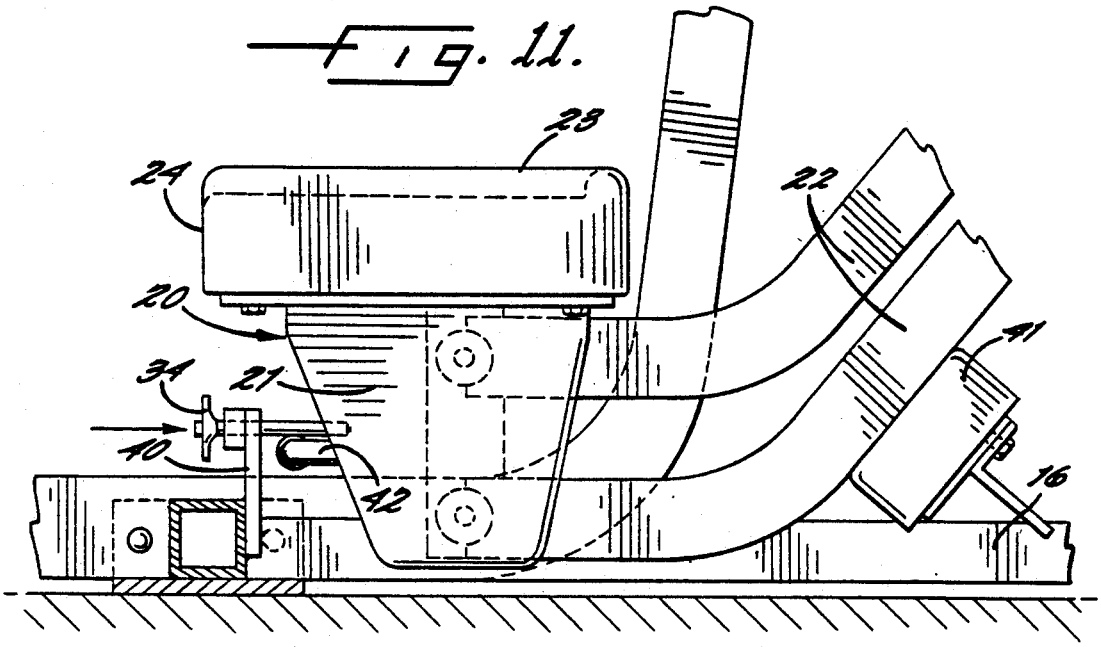
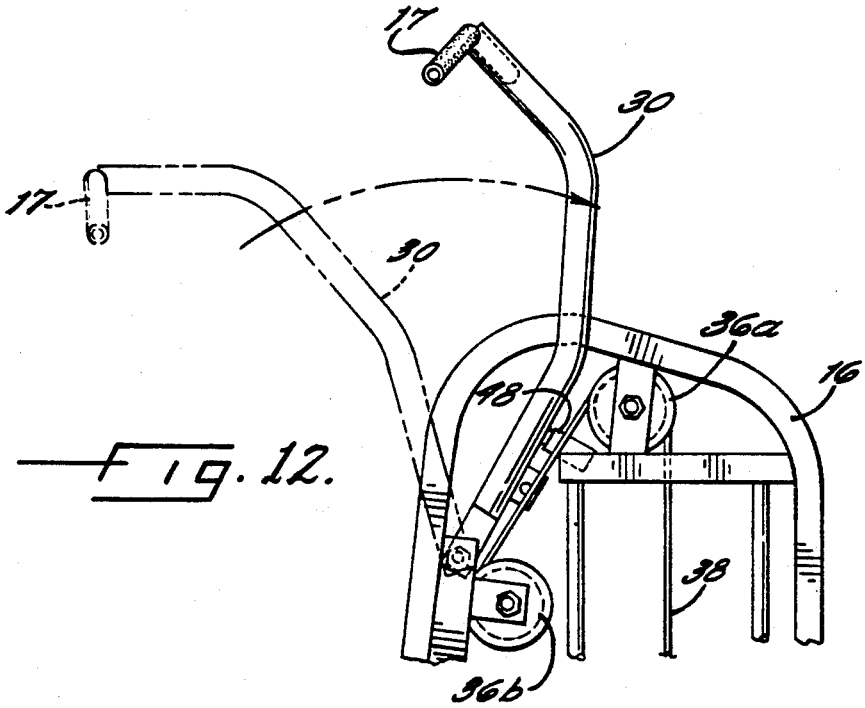
Fig. 12.

ASSISTED CHIN AND DIP EXERCISE APPARATUS

FIELD OF THE INVENTION

The invention relates to the field of exercise equipment and, more particularly, to an exercise apparatus for permitting a user to perform chin-ups or dips with assistance so that the user can lift his body with his arms while applying a force less than his own body weight.

BACKGROUND OF THE INVENTION

Exercisers frequently build and tone their muscles by performing exercises on various exercise machines. A typical exercise is a chin-up during which the user grasps a pair of overhead handles or a bar and raises himself from a fully lowered position, in which the user's arms are fully extended, to a fully raised position, in which the user's arms are bent and the user's chin is substantially even with the pair of handles or bar. The user must lift his entire body in a conventional chin-up, and repeat the exercise for the desired number of repetitions. Unfortunately, for beginners, overweight individuals, or those with relatively weak upper bodies, a chin-up can be a very difficult exercise to perform even a single time, much less a number of repetitions.

Another fairly common and related exercise is the dip in which the user grasps a pair of handles with his arms straight and extended downward along his sides. The user then lowers his body weight while bending his arms. The user then raises his body weight by straightening his arms. At a conventional dip station, the user must support and raise his full body weight during the exercise; hence, a dip is also difficult for many individuals.

Exercise machines have been developed with conventional chin and dip stations, typically in combination with other weight training equipment. For example, U.S. Pat. No. 4,781,374 to Lederman discloses such an exercise machine. In addition, exercise machines have also been developed to assist a user in performing either a chin-up, a dip, or both. Accordingly, such machines permit a user to lift his body weight during a chin-up or dip while exerting a force with his arms less than his full body weight. This assistance permits beginners and others to perform a greater number of chin-up or dip repetitions to thereby gradually build their body strength.

There are several types of assisted chin and dip exercise machines. For example, U.S. Pat. No. 5,011,139 to Towley, III, entitled Assisted Dip/Chin Exercise Device discloses a weight-assisted chin and dip exercise machine including a foot bar upon which the user stands. The foot bar is fixedly secured to a pivoting arm which, in turn, is pivotally connected to the frame of the exercise machine. The foot bar is also coupled to a user-selectable amount of weight for urging the foot bar upwardly to assist the user in performing a chin-up or dip. Unfortunately, the foot bar provides an unstable support for the user to stand upon during operation as the foot bar rotates or rolls about its longitudinal axis underneath the user's feet while the user performs a chin-up or a dip. Moreover, the user may also be thrown from the machine if the user is not careful in stepping from the machine. Thus, the safety of the user may be compromised when using an exercise machine with a foot bar.

Another assisted chin and dip exercise machine is disclosed in U.S. Pat. No. 4,849,458 to Potts entitled Upper Body Exercise Apparatus. The patent discloses a pneumatically-assisted chin and dip exercise machine having a foot platform rather than a foot bar. The foot platform is connected to a frame by a mechanical linkage that slides and rotates relative to the frame such that the platform is restricted to vertical movement only as the platform moves up and down with the user. Although the user is assisted in performing chin-ups or dips, the restriction of the platform to vertical movement only does not permit the user's body to follow the natural arcuate path traced by the center of gravity of a user's body while doing a chin-up or a dip. Accordingly, the exercise is awkward and may produce undesirable stress on the arm and shoulder joints. Moreover, the targeted muscle groups may not receive the desired degree of training.

An exercise machine, whether for home or for fitness center use, is desirably relatively compact. Both chin and dip assist machines described in U.S. Pat. Nos. 5,011,139 and 4,849,458 require that the user be accommodated in the standing position. Accordingly, both machines are quite tall, making transportation and installation difficult. The exercise machine described in U.S. Pat. No. 4,849,458 also requires considerable clearance towards the front of the machine to permit free movement of the linkage connecting the foot platform to the frame.

SUMMARY OF THE INVENTION

It is therefore an object of the invention to provide an assisted chin and dip exercise machine that is safe, relatively compact, and that permits natural body movement during the exercise.

These and other objects, features, and advantages of the present invention are provided by an exercise apparatus including guide means connected between a frame and a kneeling platform for guiding the kneeling platform along a predetermined and generally vertical arcuate path of travel as the user raises himself upward with respect to a pair of handles so that the kneeling platform remains horizontally positioned beneath the center of gravity of the user. The predetermined arcuate path of travel is defined by the natural arcuate path of travel traced by the center of gravity of a user performing a chin-up or a dip. In other words, the exercise machine of the invention permits the body to remain supported in its natural position as the user raises and lowers himself during an exercise. Accordingly, the exercise is not awkward as in conventional assisted chin and dip machines which constrain the user to move directly up and down in a vertical path despite the horizontally moving center of gravity of the user during the exercise.

The guide means is preferably provided by an equal-length four-bar linkage connecting the kneeling platform to the apparatus frame to thereby obtain the desired arcuate and generally vertical movement of the kneeling platform. The four-bar linkage also maintains the kneeling platform in a substantially horizontal orientation during the movement of the kneeling platform along the predetermined arcuate path.

The four-bar linkage moves the kneeling platform progressively horizontally in a direction outward from the user's back as the user raises his body with his arms while doing a chin-up and moves progressively upward from a fully lowered position, wherein the user's arms are fully extended in an upward direction, to a partially raised position, wherein the user's forehead is substantially even with the chin-up handles. The four-bar linkage also preferably moves the kneeling platform progressively horizontally in a direction outward from the user's front as the user moves progressively upward from the partially raised position to a fully raised position, wherein the user's shoulders are substantially level with the chin-up handles. In addition, the four-bar linkage moves the kneeling platform progressively horizontally in a direction outward from the user's back as the user raises his body while performing a dip and moves progressively upward from a fully lowered position, wherein the user's arms are fully bent, to a fully raised position, wherein the user's arms are fully extended in a downward direction.

The kneeling platform permits the user to kneel rather than stand for enhanced user safety. Moreover, the exercise apparatus is thus more vertically compact than conventional chin and dip assist machines incorporating standing foot platforms or bars.

A pair of handles may be connected to an upper portion of the frame of the exercise apparatus to serve as chin-up handles for the user in performing chin-ups. A pair of handles may be spaced apart and carried by a medial portion of the frame to define dip handles for the user to grasp while performing dips. The pair of handles connected to the upper portion of the frame to define chin-up handles are preferably provided by portions of an elongate bar to permit the user to select a variety of chin-up grip positions, such as a wide grip or a close grip position.

The exercise apparatus also includes bias means connected to the kneeling platform for urging the kneeling platform upward. The bias means thus permits the user to raise his body with his arms while applying a force with his arms less than his own body weight. As would be readily appreciated by those skilled in the art, the bias means is preferably provided by a plurality of weights arranged in a stack and includes means for coupling a predetermined number of the weights to the kneeling platform.

Another feature of the exercise machine according to the invention is that the elongate bar providing the chin-up handles is preferably pivotally connected to the upper portion of frame. The elongate bar permits close grip chin-ups while also being movable between a normal position, extending generally above the kneeling platform, to a stored position, away from the kneeling platform, so that the elongate bar does not hinder the user's performance of dips.

The exercise machine may also optionally be readily converted to serve as an unassisted chin or dip station. The exercise machine preferably includes lock out means for securing the kneeling platform to a lower portion of the frame so that the user may raise and lower his body without being supported by the kneeling platform.

BRIEF DESCRIPTION OF THE DRAWINGS

FIG. 11 is a greatly enlarged side elevational view of the kneeling platform and a portion of the chin and dip exercise apparatus according to the present invention illustrating the kneeling platform in a locked down position.

FIG. 12 is an enlarged side elevational view of the elongate base providing the chin-up handles of the exercise apparatus according to the invention illustrating the pivotal movement of the handles between a normal position for grasping by a user and a stored position for permitting the user to perform dips.

DETAILED DESCRIPTION OF THE PREFERRED EMBODIMENT

The present invention will now be described more fully hereinafter with reference to the accompanying drawings, in which a preferred embodiment of the invention is shown. This invention may, however, be embodied in many different forms and should not be construed as limited to the embodiment set forth herein. Rather, applicants provide this embodiment so that this disclosure will be thorough and complete, and will fully convey the scope of the invention to those skilled in the art. Like numbers refer to like elements throughout. The pronouns his and her are used interchangeably throughout to mean a user of the exercise apparatus.

Figure 1:
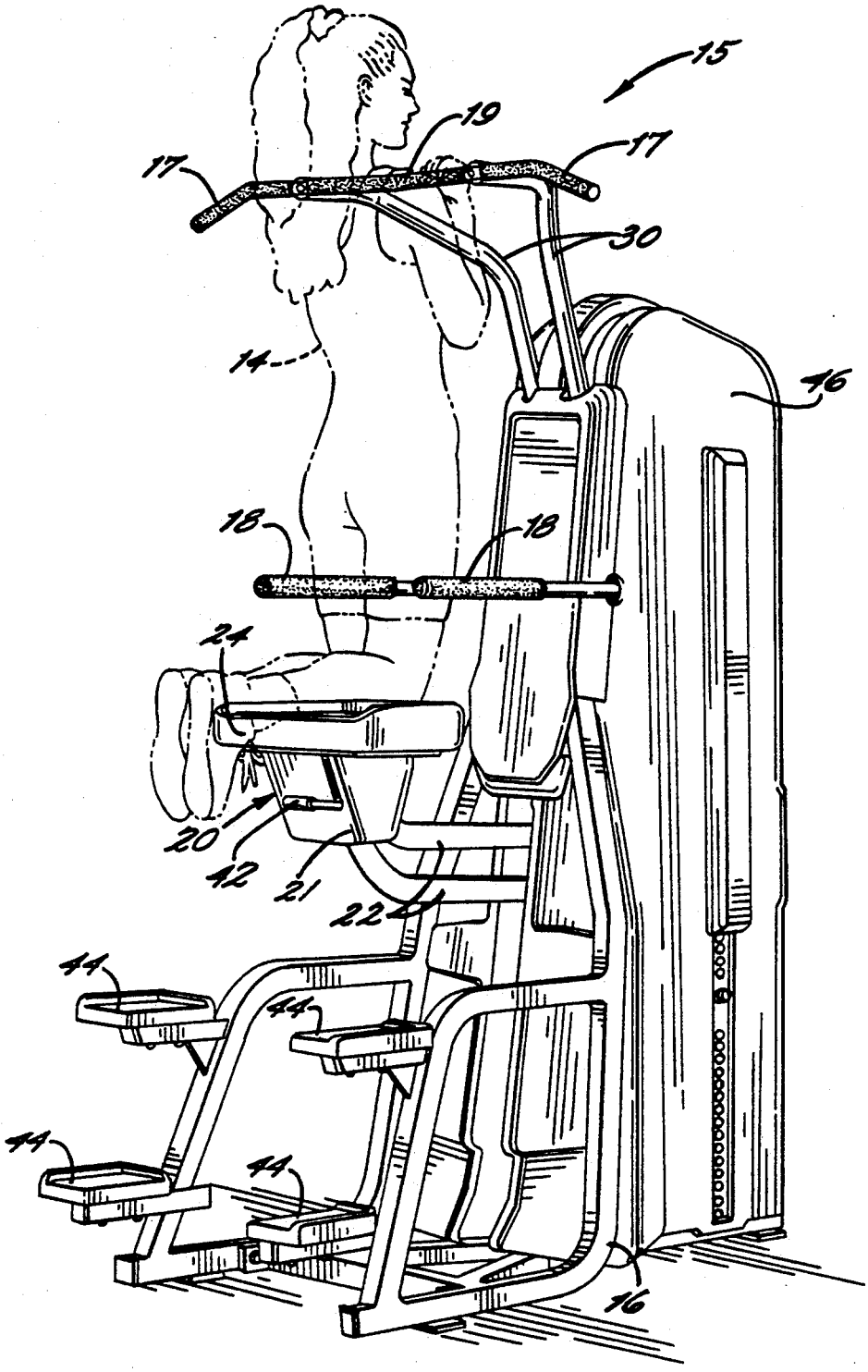
FIG. 1 is a perspective view of a chin and dip exercise apparatus according to the invention.
Figure 2:
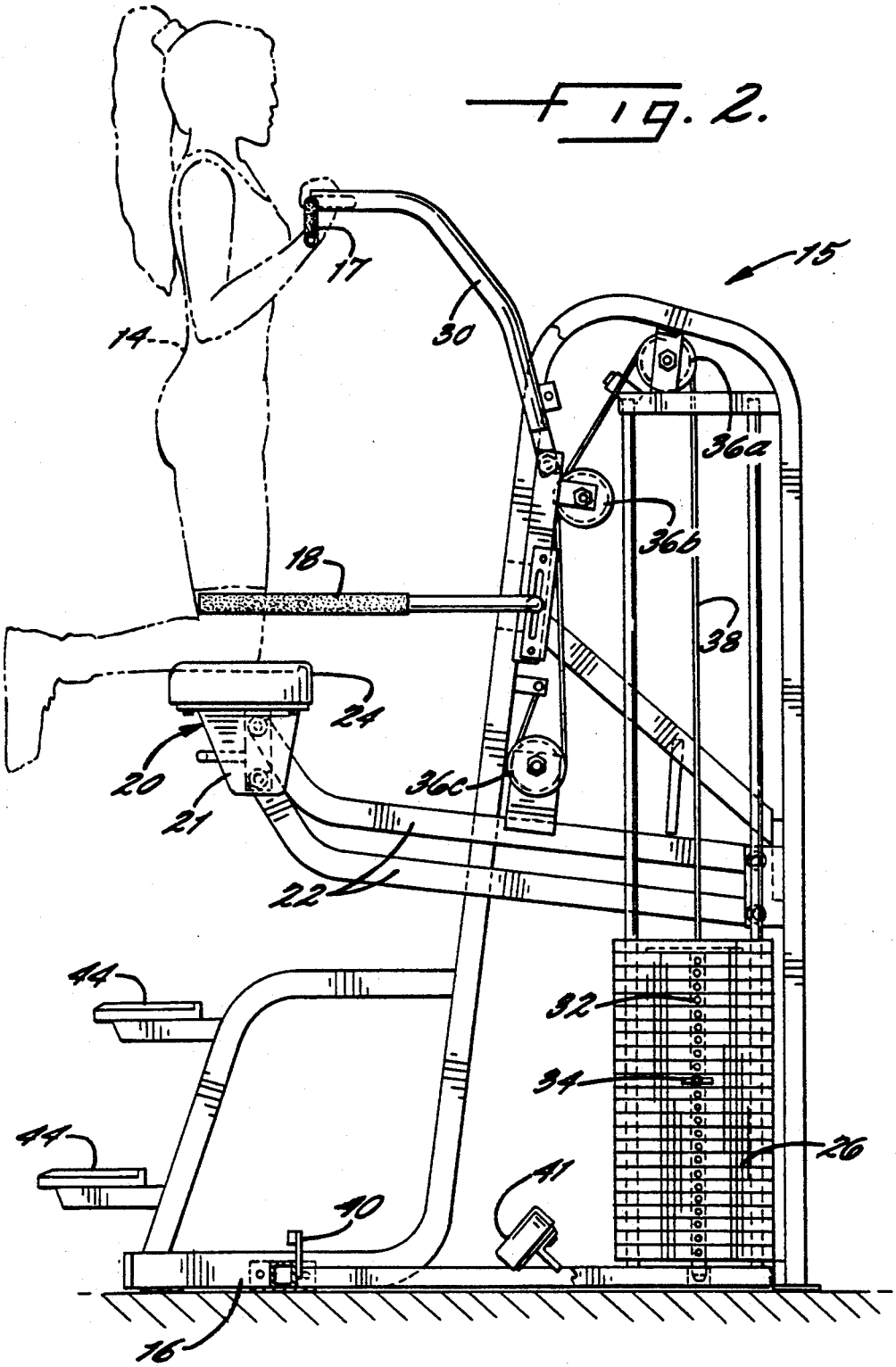
FIGS. 2 and 3 are side elevational views of the chin and dip exercise apparatus according to the invention with the housing removed for clarity and illustrating the movement of the weight stack as a user performs a chin-up.
Figure 3:
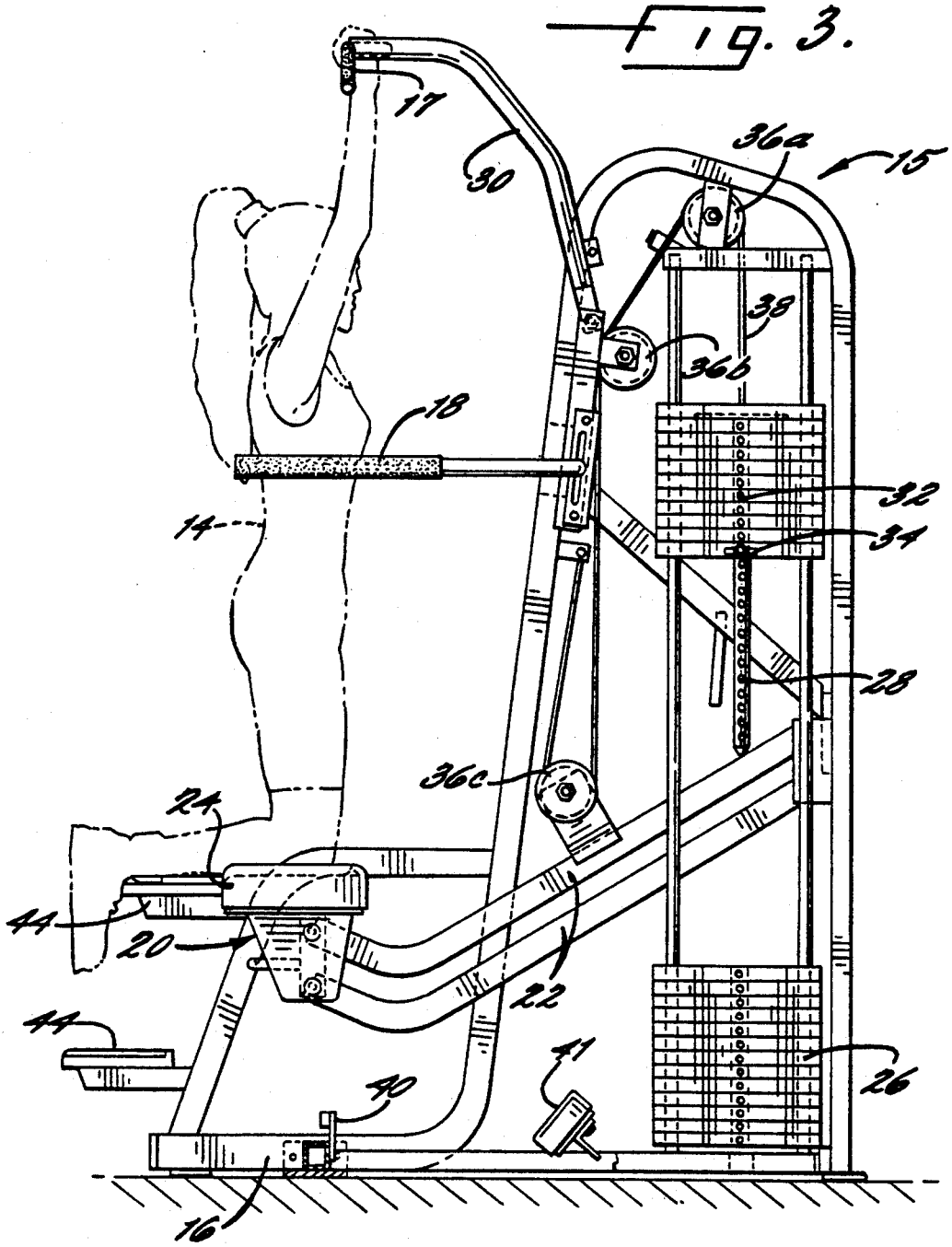

A chin and dip exercise apparatus according to the present invention is generally designated in the accompanying drawings by numeral 15. Referring first to FIGS. 1-3, the chin and dip exercise apparatus 15 includes a frame 16, such as formed of metal tubular stook, to thus provide lightweight and high strength for the apparatus. As illustrated, a first pair of handles 17 are carried by an upper portion of the frame 16, and a second pair of handles 18 are carried in spaced apart relation by a medial portion of the frame. The handles 17 and 18 are adapted for grasping by the user 14 to perform either chin-ups or dips, respectively.

The first pair of handles 17 are preferably provided by an elongate bar 19 having angled end portions to thereby enable grasping by the user 14 with different hand grip positions while performing a chin-up. As would be readily understood by those skilled in the art, a wide grip position or a close grip position may thus be readily accommodated by the exercise apparatus 15.

The exercise apparatus 15 also includes a kneeling platform 20 adapted to support the user 14 while the user 14 grasps the handles 17, 18 during a chin-up or dip. The kneeling platform 22 is operatively connected to the frame 16 by guide means, such as the equal-length four-bar linkage 22 as illustrated, which guides the kneeling platform along a predetermined and generally vertical arcuate path of travel as the user 14 raises herself upward with respect to the handles 17, 18. The equal-length four-bar linkage also provides means for maintaining the upper surface of the kneeling platform 20 in a generally horizontal orientation during the exercise. As would be readily understood by those skilled in the art, the guide means may be provided by other arrangements, such as an arcuately-shaped track extending in a generally vertical direction, not shown.

The exercise apparatus 15 includes bias means operatively connected to the kneeling platform 20 for urging the kneeling platform upward along the path of travel. The bias means permits the user 14 to raise her body with her arms while applying a force with her arms less than her own body weight. As shown best in FIGS. 2 and 3, the bias means is preferably provided by a plurality of weights 26 arranged in a stack and includes means for coupling a predetermined number of the weights to the kneeling platform 20. As illustrated, the coupling means may be provided by a cable 38 routed over a series of spaced apart pulleys 36*a*, 36*b* and 36*c*. A tube 28, including a series of spaced apart openings, is connected to the cable 38, and a pin 34 cooperates with the openings in the tube to permit the user 14 to select the desired number of weights 26 to thereby select the degree of assistance provided during the exercise. Accordingly, the exercise apparatus 15 permits a user 14, such as a beginner or someone with a relatively weak upper body, to perform a desired number of chin-up or dip repetitions.

The exercise apparatus 15 also preferably includes a pair of steps 44 attached on each opposing side of a lower portion of the frame 16 as shown. The steps 44 permit the user 14 to safely mount the kneeling platform 20 to perform a chin-up or dip. The steps 44 also aid the user 14 in safely and easily dismounting from the exercise apparatus 15. The steps 44 include a padded surface in case the user 14 accidentally contacts the steps with a part of the body other than the foot. The steps 44 also include a raised edge on the forward and outside edges and extending upwardly to assist in proper placement of the feet upon the steps and to prevent slipping from the steps.

A shroud or housing 46 is preferably secured to the frame 16 and surrounds the stack of weights 26, as well as the pulleys 36*a*, 36*b* and 36*c*, cable 38, and a portion of the four-bar linkage 22. The housing 46 thus provides enhanced safety and improved aesthetics for the exercise apparatus 15 according to the invention.

Figure 4:
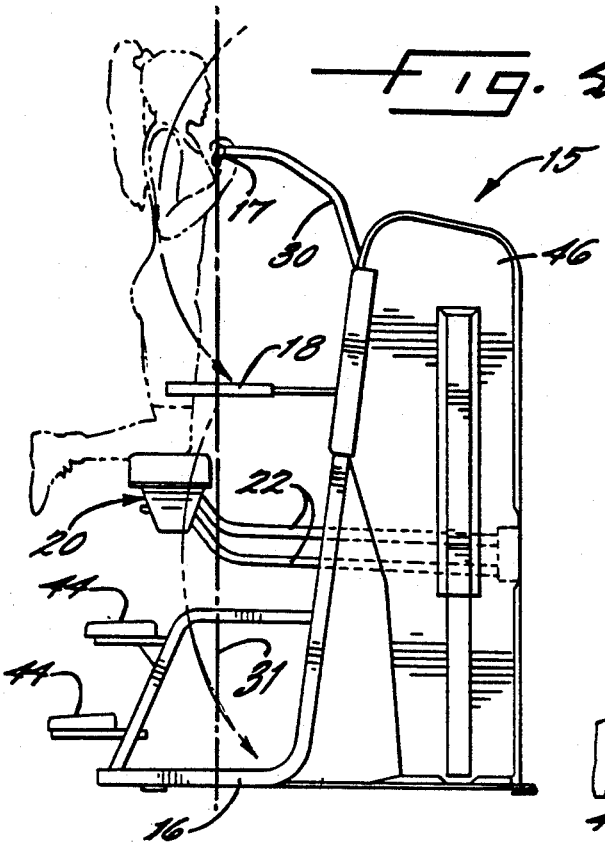
FIGS. 4, 5 and 6 are side elevational views of the chin and dip exercise apparatus according to the invention illustrating a user in the fully raised position, the partially raised position, and the fully lowered position, respectively, while performing a chin-up.
Figure 5:
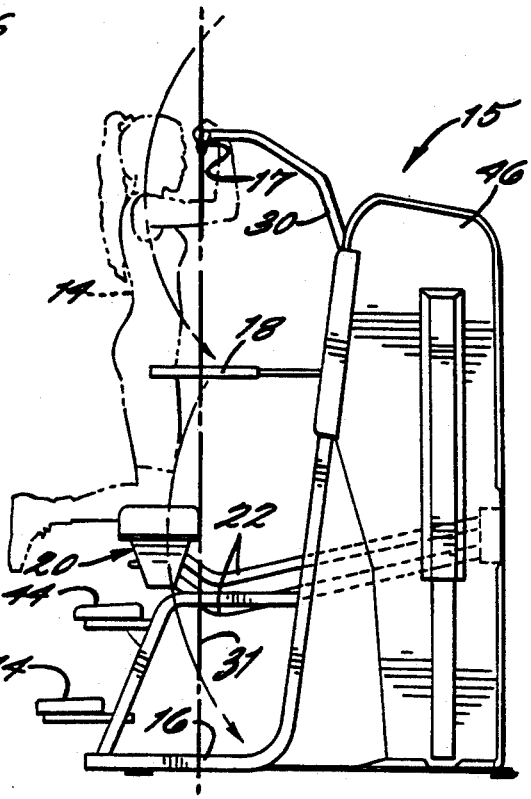
Figure 6:
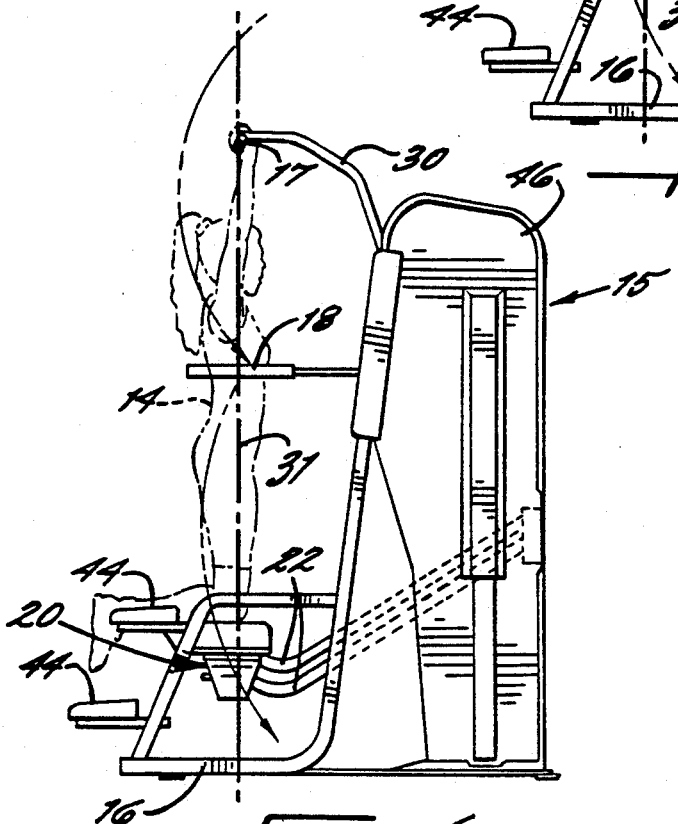

Referring now to FIGS. 4–6, a significant feature of the present invention is best understood. The guide means provided by the four-bar linkage 22 of the apparatus 15 causes the kneeling platform 20 to move through a predetermined arcuate and generally vertical path of travel corresponding to the natural arcuate path of travel traced by the center of gravity of the user 14 while performing a chin-up. The four-bar linkage 22 has a predetermined length and is connected at a predetermined location on the frame 16 with respect to the handles 17 so that a substantial portion of the kneeling platform 20 crosses an imaginary vertical plane 31 extending through handles 17, 18 as the kneeling platform 20 remains horizontally positioned beneath the center of gravity of the user 14 during the chin-up.

In other words, the guide means provided by the four-bar linkage moves the kneeling platform 20 progressively horizontally outward from the imaginary vertical plane 31 in a first direction outward from the user's back as the user 14 raises her body with her arms and moves progressively upward from a fully lowered position, wherein the user's arms are fully extended in an upward direction as shown in FIG. 6, to a partially raised position, wherein the user's forehead is substantially even with the chin-up handles 17 as shown in FIG. 5, during the performance of a chin-up.

Similarly, the four-bar linkage also moves the kneeling platform 20 progressively horizontally inward toward the imaginary vertical plane 31 in a second direction outward from the user's front as a user 14 moves progressively upward from the partially raised position shown in FIG. 5 to the fully raised position, wherein the user's shoulders are substantially level with the chin-up handles 17 as shown in FIG. 4, during the performance of a chin-up.

For a typical user 14, an imaginary centerline through the center of gravity of the user 14 is spaced about 5.5" from an imaginary plumb line drawn through the chin-up handles 17 in the fully raised position (FIG. 4), about 6.75" in the partially raised position (FIG. 5), and about 1.5" in the fully lowered position (FIG. 6). Accordingly, the kneeling platform 20 is maintained substantially below the center of gravity of the user 14 throughout the chin-up and results in a natural exercise movement to fully exploit the workout on the targeted muscle groups.

Figure 7:
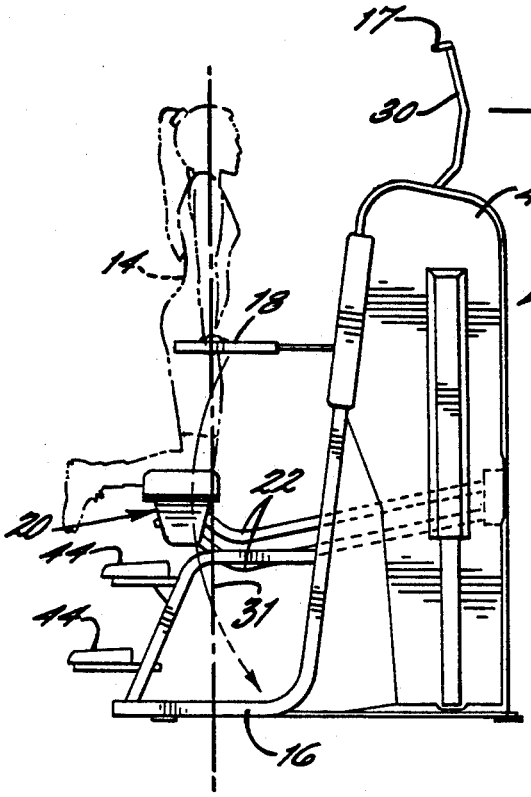
FIGS. 7 and 8 are side elevational views of the chin and dip exercise apparatus according to the invention illustrating a user in the fully raised position and the fully lowered position, respectively, while performing a dip.
Figure 8:
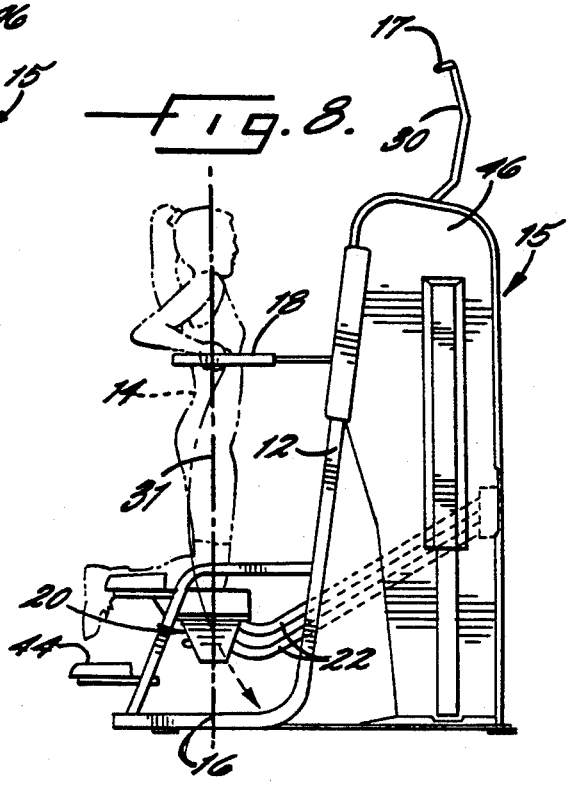

Referring now to FIGS. 7 and 8, a user 14 performing a dip is illustrated. The guide means provided by the four-bar linkage 22 also moves the kneeling platform 20 progressively horizontally in a direction outward from the user's back as the user 14 grasps the dip handles 18 and raises her body moving progressively upward from a fully lowered position as shown in FIG. 8, where the user's arms are fully bent, to a fully raised position as shown in FIG. 7, where the user's arms are fully extended in a downward direction. The guide means positions the kneeling platform 20 beneath the horizontally moving center of gravity of the user 14 during a dip, as well as during a chin-up as described above.

Figure 9:
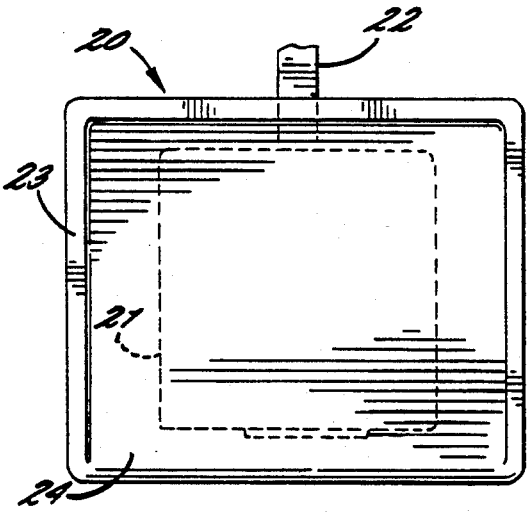
FIG. 9 is an enlarged plan view of the kneeling platform of the chin and dip exercise apparatus according to the invention.
Figure 10:
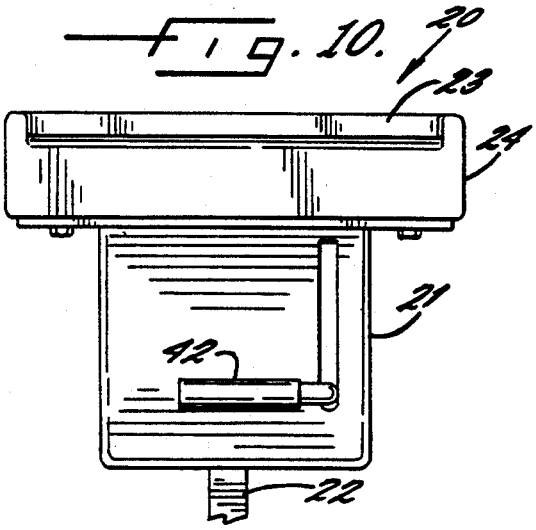
FIG. 10 is a front elevational view of the kneeling platform of the chin and dip exercise apparatus according to the invention.

FIGS. 9 and 10 illustrate additional features of the kneeling platform 20 according to the invention. The kneeling platform 20 preferably includes a base 21 and an upper pad 24 secured to the base. The pad 24 includes an integrally molded peripheral lip 23 extending upwardly from three side edges, as illustrated, to ensure correct positioning of the user's knees on the pad. The fourth side edge of the pad 24 is flush with the major surface of the pad to permit the user's lower legs to comfortably extend beyond the kneeling platform.

Referring now additionally to FIG. 11, another feature of the invention is best explained. The kneeling platform 20 preferably includes a lockout arm 42 extending outwardly from the base 21. The lockout arm 42 cooperates with a removable pin 34, such as, for example, the pin from the weight stack, a bracket 40 secured to the frame 16, and a stop 41 carried by the frame 16 to provide kneeling platform lockout means to permit the user 14 to perform unassisted chin-ups or dips if desired.

Referring now to FIG. 12 yet another feature of the present invention is explained. The elongate bar 19 providing the upper pair of handles 17 for chin-ups is preferably carried by two parallel arms 30 pivotally secured to an upper portion of the frame 16. The elongate bar 19 may be pivoted out of the way of the user 14 to a stored position for performing dips. The arms 30 may be pivoted upwardly to rest against respective stops 48 carried by the frame 16 in the stored position. In other words, the chin-up handles 17 are movable between a normal position extending generally above the kneeling platform 20, and a stored position, away from the kneeling platform to permit the user 14 to perform dips.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An exercise apparatus for permitting a user to raise his body with his arms, said exercise apparatus comprising:

a frame;

a pair of handles connected to said frame and adapted for grasping by the user;

a kneeling platform adapted for supporting the user while the user grasps said pair of handles;

guide means operatively connected between said frame and said kneeling platform for guiding said kneeling platform along a predetermined arcuate and generally vertical path of travel as the user raises himself upward with respect to said pair of handles so that a substantial portion of said kneeling platform crosses an imaginary vertical plane extending through said pair of handles and remains horizontally positioned beneath a horizontally moving center of gravity of the user; and bias means operatively connected to said kneeling platform for urging same in an upward direction along the path of travel to thereby permit the user to raise his body with his arms while applying a force with his arms less than his own body weight.

2. An exercise apparatus according to claim 1 wherein said guide means includes means for maintaining said platform in a substantially horizontal orientation as said kneeling platform moves along said predetermined arcuate path.

3. An exercise apparatus according to claim 1 wherein said pair of handles are connected to an upper portion of said frame to thereby define chin-up handles for the user.

4. An exercise apparatus according to claim 3 wherein said guide means includes means for moving said kneeling platform progressively horizontally outward from said imaginary vertical plane in a first direction outward from the user's back as the user raises his body with his arms and moves progressively upward from a fully lowered position, wherein the user's arms are fully extended in an upward direction, to a partially raised position, wherein the user's forehead is substantially even with said chin-up handles.

5. An exercise apparatus according to claim 4 wherein said guide means further includes means for moving said kneeling platform progressively horizontally inward toward said imaginary vertical plane in a second direction outward from the user's front as the user moves progressively upward from the partially raised position to a fully raised position, wherein the user's shoulders are substantially level with said chin-up handles.

6. An exercise apparatus according to claim 1 wherein said pair of handles comprise predetermined portions of an elongate bar to thereby permit the user to select various spacings for hand grip positions.

7. An exercise apparatus according to claim 6 wherein said elongate bar is pivotally connected to said frame and movable between a normal position extending generally above said kneeling platform and a stored position away from said kneeling platform.

8. An exercise apparatus according to claim 1 wherein said pair of handles are positioned in spaced apart relation and are connected to a medial portion of said frame to thereby define dip handles for the user.

9. An exercise apparatus according to claim 8 wherein said guide means includes means for moving said kneeling platform progressively horizontally outward from said imaginary vertical plane in a first direction outward from the user's back as the user raises his body and moves progressively upward from a fully lowered position, wherein the user's arms are fully bent, to a fully raised position, wherein the user's arms are fully extended in a downward direction.

10. An exercise apparatus according to claim 1 wherein said bias means comprises a plurality of weights arranged in a stack, and means for coupling a predetermined number of said weights to said kneeling platform.

11. An exercise apparatus according to claim 1 further comprising kneeling platform lockout means carried by said frame for securing said kneeling platform to a lower portion of said frame to thereby permit the user to raise his body without being supported by said kneeling platform.

12. An exercise apparatus for permitting a user to raise his body with his arms, said exercise apparatus comprising:

a frame;

a first pair of handles adapted for grasping by the user and connected to an upper portion of said frame to thereby define chin-up handles for the user;

a second pair of spaced apart handles adapted for grasping by the user and connected to a medial portion of said frame to thereby define dip handles for the user;

a kneeling platform adapted for supporting knees of the user while the user grasps one of said chin-up handles and said dip handles;

guide means operatively connected between said frame and said kneeling platform for guiding said kneeling platform along a predetermined arcuate and generally vertical path of travel as the user raises himself upward with respect to one of said chin-up handles or said dip handles so that a substantial portion of said kneeling platform crosses an imaginary vertical plane extending through said pair of handles and remains horizontally positioned beneath a horizontally moving center of gravity of the user; and bias means operatively connected to said kneeling platform for urging same in an upward direction along the path of travel to thereby permit the user to raise his body with his arms while applying a force with his arms less than his own body weight.

13. An exercise apparatus according to claim 12 wherein said guide means includes means for maintaining said platform in a substantially horizontal orientation as said kneeling platform moves along said predetermined arcuate path.

14. An exercise apparatus according to claim 12 wherein said guide means includes means for moving said kneeling platform progressively horizontally in a first direction outward from said imaginary vertical plane outward from the user's back as the user grasps said chin-up handles and raises his body with his arms and moves progressively upward from a fully lowered position, wherein the user's arms are fully extended in an upward direction, to a partially raised position, wherein the user's forehead is substantially even with said chin-up handles.

15. An exercise apparatus according to claim 14 wherein said guide means further includes means for moving said kneeling platform progressively horizontally inward toward said imaginary vertical plane in a second direction outward from the user's front as the user grasps said chin-up handles and raises his body progressively upward with his arms from the partially raised position to a fully raised position, wherein the user's shoulders are substantially level with said chin-up handles.

16. An exercise apparatus according to claim 12 wherein said guide means includes means for moving said kneeling platform progressively horizontally outward from said imaginary vertical plane in a first direction outward from the user's back as the user grasps said dip handles and raises his body and moves progressively upward from a fully lowered position, wherein the user's arms are fully bent, to a fully raised position, wherein the user's arms are fully extended in a downward direction.

17. An exercise apparatus according to claim 12 wherein said chin-up handles comprise predetermined portions of an elongate bar to thereby permit the user to select various spacings for hand grip positions.

18. An exercise apparatus according to claim 17 wherein said elongate bar is pivotally connected to said frame and movable between a normal position extending generally above said kneeling platform and a stored position away from said kneeling platform.

19. An exercise apparatus according to claim 12 wherein said bias means comprises a plurality of weights arranged in a stack, and means for coupling a predetermined number of said weights to said kneeling platform.

20. An exercise apparatus according to claim 12 further comprising kneeling platform lockout means carried by said frame for securing said kneeling platform to a lower portion of said frame to thereby permit the user to raise his body without support from said kneeling platform.

21. An exercise apparatus for permitting a user to raise his body with his arms, said exercise apparatus comprising:

a frame;

a pair of handles connected to said frame and adapted for grasping by the user;

a kneeling platform adapted for supporting knees of the user while the user grasps said pair of handles;

a four-bar linkage pivotally connected at one end to said frame and at an opposite end to said kneeling platform for guiding said kneeling platform along a predetermined arcuate and generally vertical path of travel as the user raises himself upward with respect to said pair of handles so that a substantial portion of said kneeling platform crosses an imaginary vertical plane extending through said pair of handles and remains horizontally positioned beneath a horizontally moving center of gravity of the user and for maintaining said platform in a substantially horizontal orientation as said kneeling platform moves along said predetermined arcuate path; and bias means operatively connected to said kneeling platform for urging same in an upward direction along the path of travel to thereby permit the user to raise his body with his arms while applying a force with his arms less than his own body weight.

22. An exercise apparatus according to claim 21 wherein said pair of handles are connected to an upper portion of said frame to thereby define chin-up handles for the user.

23. An exercise apparatus according to claim 22 wherein said four-bar linkage is connected to said frame at a predetermined height with respect to said chin-up handles, and said four-bar linkage has a predetermined length so that said kneeling platform moves progressively horizontally outward from said imaginary vertical plane in a first direction outward from the user's back as the user raises his body with his arms and moves progressively upward from a fully lowered position, wherein the user's arms are fully extended in an upward direction, to a partially raised position, wherein the user's forehead is substantially even with said chin-up handles.

24. An exercise apparatus according to claim 22 wherein said chin-up handles comprise predetermined portions of an elongate bar to thereby permit the user to select various spacings for hand grip positions.

25. An exercise apparatus according to claim 24 wherein said elongate bar is pivotally connected to said frame and movable between a normal position extending generally above said kneeling platform and a stored position away from said kneeling platform.

26. An exercise apparatus according to claim 21 wherein said pair of handles are positioned in spaced apart relation and connected to a medial portion of said frame to thereby define dip handles for the user.

27. An exercise apparatus according to claim 26 wherein said four-bar linkage is connected to said frame at a predetermined height with respect to said dip handles, and said four bar linkage has a predetermined length so that said kneeling platform moves progressively horizontally outward from said imaginary vertical plane in a first direction outward from the user's back as the user raises his body and moves progressively vertically from a fully lowered position, wherein the user's arms are fully bent, to a fully raised position, wherein the user's arms are fully extended in a downward direction toward said dip handles.

28. An exercise apparatus according to claim 21 wherein said bias means comprises a plurality of weights arranged in a stack, and means for coupling a predetermined number of said weights to said kneeling platform.

* * * * *